US007982697B2

(12) United States Patent
Kasai et al.

(10) Patent No.: US 7,982,697 B2
(45) Date of Patent: Jul. 19, 2011

(54) DISPLAY DEVICE MOUNTED WITH SELF-LUMINOUS ELEMENT

(75) Inventors: Naruhiko Kasai, Yokohama (JP); Masato Ishii, Tokyo (JP); Tohru Kohno, Kokubunji (JP); Hajime Akimoto, Kokubunji (JP)

(73) Assignee: Hitachi Displays, Ltd., Chiba (JP)

( * ) Notice: Subject to any disclaimer, the term of this patent is extended or adjusted under 35 U.S.C. 154(b) by 934 days.

(21) Appl. No.: 11/871,469

(22) Filed: Oct. 12, 2007

(65) Prior Publication Data

US 2008/0100543 A1 May 1, 2008

(30) Foreign Application Priority Data

Oct. 13, 2006 (JP) ..... 2006-279986

(51) Int. Cl.
*G09G 3/30* (2006.01)

(52) U.S. Cl. ..... 345/77

(58) Field of Classification Search ..... 345/77
See application file for complete search history.

(56) References Cited

U.S. PATENT DOCUMENTS

| | | | | |
|---|---|---|---|---|
| 6,950,081 | B2 | 9/2005 | Akimoto | |
| 2003/0067424 | A1 * | 4/2003 | Akimoto et al. | 345/55 |
| 2004/0004591 | A1 * | 1/2004 | Akimoto et al. | 345/84 |
| 2005/0007316 | A1 | 1/2005 | Akimoto et al. | |
| 2005/0140609 | A1 * | 6/2005 | Akimoto et al. | 345/76 |
| 2005/0212783 | A1 * | 9/2005 | Kasai et al. | 345/204 |
| 2006/0055631 | A1 * | 3/2006 | Yoshida | 345/46 |
| 2006/0077195 | A1 | 4/2006 | Kageyama | |
| 2006/0158398 | A1 | 7/2006 | Akimoto | |

FOREIGN PATENT DOCUMENTS

| | | |
|---|---|---|
| CN | 1551076 | 12/2004 |
| JP | 2002-278514 | 9/2002 |
| JP | 2003-122301 | 4/2003 |
| JP | 2006-106522 | 4/2006 |
| JP | 2006-195307 | 7/2006 |

* cited by examiner

*Primary Examiner* — Richard Hjerpe
*Assistant Examiner* — Andrew Schnirel
(74) *Attorney, Agent, or Firm* — Antonelli, Terry, Stout & Kraus, LLP.

(57) ABSTRACT

A display device includes a plurality of pixels, each of which has a drive transistor, an organic EL element and a writing capacitor, in which the drive transistor controls a luminous time period of the organic EL element by a writing signal voltage and a sweep signal so that the writing signal voltage is written into the writing capacitor independent from a characteristic variation caused by a deterioration due to the temperature and time lapse of using the organic EL element, thereby making a luminous time period long when the deterioration occurs with increase of an internal resistance of the organic EL element, and compensating a luminance degradation caused by the deterioration to solve a burn-in state of fixed pattern.

17 Claims, 9 Drawing Sheets

DISPLAY DEVICE MOUNTED WITH SELF-LUMINOUS ELEMENT

CLAIM OF PRIORITY

The present application claims priority from Japanese Application No. 2006-279986 filed on Oct. 13, 2006, the content of which is hereby incorporated by reference into this application.

BACKGROUND OF THE INVENTION

The present invention relates to a display device mounted with self-luminous elements as self-luminous type display elements such as EL (Electroluminescence) elements, organic EL element elements, etc.

In the case of the self-luminous element typified by the EL element, organic EL element, etc., the element has a property such that the luminance of that is proportional to a current amount flown into the self-luminous element, so that a display of gradation sequence can be made by controlling the current amount flown into the self-luminous element. In this way, a display device can be made by arranging a plurality of the self-luminous elements.

However, if the self-luminous element is used in an extended period of time, the element has a property such that a deterioration of the element makes progress along with time lapse, and the luminance of that reduces. The rate of deterioration is dependent on the time period of luminance in this case. Therefore, a burn-in pattern occurs in response to a luminous state (displayed pattern) of individual pixels.

As a technique to solve the burn-in pattern caused by the deterioration of self-luminous element due to the time lapse, JP-A-2002-278514 discloses a technique in which a drive current is measured for every pixel train (one train of column direction), a rate of the deterioration is detected from the amount of drive current, and a result of the detection is fed back to a signal voltage, thereby solving the burn-in pattern.

SUMMARY OF THE INVENTION

However, in the case of the technique disclosed in JP-A-2002-278514, it is necessary to mount a series resistor and an ADC (A/D converter), as a current detection circuit, in every pixel train on a glass substrate. For this reason, there arises a problem that a size of a circuit and an area (frame) are increased, and a number of new interface signals are required for applying the foregoing feed back technique when the signal voltage is supplied from an outside of panel.

An object of the invention is to provide a display device to solve occurrence of a burn-in pattern by controlling a luminous period of the self-luminous element in response to the deterioration, without providing the interface signal for the feed-back to the outside of panel (outside of glass substrate).

According to an aspect of the invention, a display device has a display panel arranged by a plurality of pixels, a scanning line driving circuit that selects the pixel arranged on the display panel, and a data line driving circuit that supplies a signal voltage to the pixel selected by the scanning line driving circuit, in which the pixel provides a luminous element, a transistor for driving the luminous element and a writing capacitor for fetching a signal voltage in accordance with an input reference voltage of the transistor, and the transistor controls a luminous period in accordance with the input reference voltage shifted in response to a characteristic of the luminous element.

According to another aspect of the invention, a self-luminous display device is constituted by a display element unit arranged in matrix-shaped arrangement with self-luminous elements, summation of luminous currents of which is controlled in accordance with a writing signal voltage; a writing signal voltage control circuit that generates the writing signal voltage in response to input data; a writing capacitor that stores the writing signal voltage; a sweep signal generation circuit that generates one cycle sweep signal in a luminous time period after a writing completion for all of pixels; signal lines that supply the writing signal voltage to the writing capacitor for each of the pixels in a writing time period and the sweep signal to the writing capacitor in the luminous time period; a power supply device that supplies a luminous current to the self-luminous elements; a drive transistor that controls the luminous period in accordance with a comparison result of the writing signal voltage and the sweep signal signal; a characteristic capacitor that stores a characteristic of the drive transistor independent from a characteristic of one self-luminous element connected in parallel with other self-luminous element; a reset switch connected between a gate and a source of the drive transistor; a characteristic hold switch connected between the source of the drive transistor and one end of the characteristic capacitor; and a luminance control switch connected between the source of the drive transistor and one end of the self-luminous element.

On the writing time period, the writing signal voltage is stored in the writing capacitor by controlling the reset switch and the characteristic hold switch on the basis of a threshold value voltage of the drive transistor independent from the self-luminous element characteristic stored in the characteristic capacitor.

On the luminous time period, the self-luminous element is made into a luminous state by controlling the luminance control switch.

With input of the sweep signal from the signal line, the level of sweep signal is based on the characteristic independent from the self-luminous element characteristic stored in the writing capacitor. In contrast, the threshold value voltage of drive transistor becomes a threshold value voltage added with the characteristic of self-luminous element. Therefore, the luminous period is controlled in response to a characteristic variation caused by a deterioration due to a temperature and time lapse of the self-luminous element.

According to the invention, the invention provides a display device having a stable luminance among the pixels without causing a burn-in pattern due to the deterioration of time lapse. In this way, the display device is desirable for DVC (Digital Video Camera), DSC (Digital Still Camera), mobile telephones, etc., which essentially requires icon displays, because the burn-in state of a fixed pattern can be eliminated.

Other objects, features and advantages of the invention will become apparent from the following description of the embodiments of the invention taken in conjunction with the accompanying drawings.

DETAILED DESCRIPTION OF THE EMBODIMENTS

Embodiments of the invention will be described below with the reference to the drawings.

Embodiment 1

Figure 1:
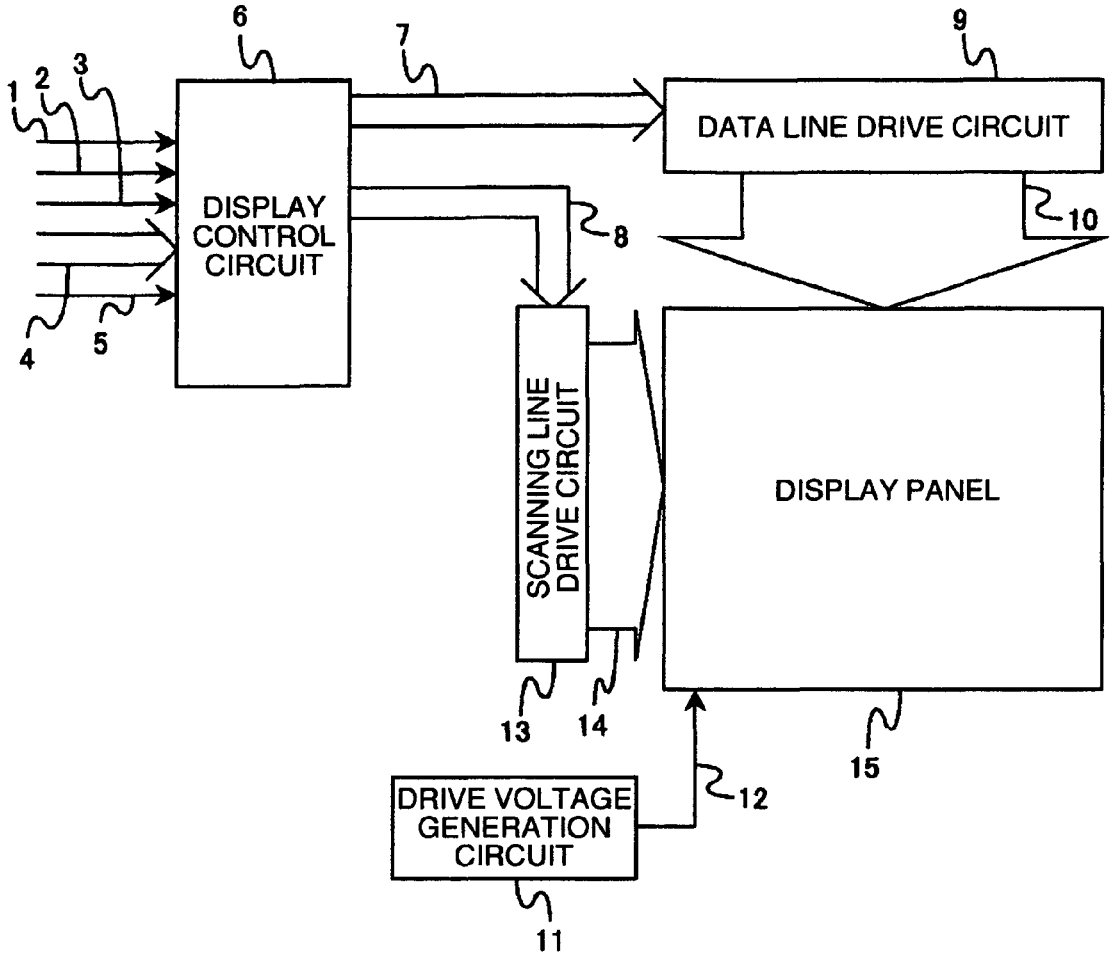
FIG. 1 is a diagram showing an example of self-luminous element display device in an embodiment of the invention.

FIG. 1 is a diagram showing an example of a self-luminous element display device in an embodiment of the invention. Referring to FIG. 1, a reference numeral 1 denotes a vertical sync signal; 2, a horizontal sync signal; 3, a data enable signal; 4, display data (either analog or digital may be acceptable); and 5 denotes a sync clock. The vertical sync signal 1 is of one screen cycle (or one frame cycle) for displaying the display data 4. The horizontal sync signal 2 is a signal of one horizontal cycle. The data enable signal 3 is a signal indicating a valid period (display valid period) of the display data 4. All of the signals are synchronized with the sync clock 5 to be input to the display device.

In the case of the embodiment, the display data 4 by an amount of one screen is, in turn, transferred from a pixel at an upper left end of a display screen by the raster scan system. Information by an amount of one pixel will be described as digital data configured by 6 bits. In this regard, the information by an amount of one pixel may also be 8 bits, 10 bits, etc.

Referring back to FIG. 1, a reference numeral 6 denotes a display control circuit; 7, a data line control signal; and 8, a scanning line control signal. The display control circuit 6 generates the data line control signal 7 and scanning line control signal 8 from the vertical sync signal 1, horizontal sync signal 2, data enable signal 3, display data 4, and vertical clock 5.

Further, a reference numeral 9 denotes a data line drive circuit, and 10 denotes a data line drive signal. The data line drive circuit 9 generates a signal voltage written into the pixel configured by self-luminous element and a sweep signal signal in accordance with the data line control signal 7 to output as the data line drive signal 10.

A reference numeral 11 denotes a drive voltage generation circuit, and 12 denotes a panel supply drive voltage. The drive voltage generation circuit 11 generates a power supply voltage for supplying a current to produce luminescence from the self-luminous element and output as a panel supply drive voltage 12.

A reference numeral 13 denotes a scanning line drive circuit, 14 denotes a scanning line drive signal, and 15 denotes a display panel. The display panel 15 provides the self-luminous elements, with a matrix arranged, using such as light-emitting diodes, organic EL elements, etc. An operation of display panel 15 is carried out by the following manner. First, a signal voltage corresponding to the data line drive signal 10 output from the data line drive circuit 9 is written into a pixel selected by the scanning line drive signal 14 output from the scanning line drive circuit 13. Thereafter, a sweep signal is supplied to the pixel to thereby produce luminescence from the self-luminous element. A voltage for driving the self-luminous element is supplied as the panel supply drive voltage 12.

In addition, the data line drive circuit 9 and scanning line drive circuit 13 may be realized by a LSI for each, or may be realized by a single LSI. The single or plural LSIs may be configured on a glass substrate on which a pixel unit configured by the self-luminous elements is also configured.

In the case of the embodiment, description will be concerned with a configuration below, that is, the display panel 15 has a resolution of 240×320 dots, and one dot is configured by 3 pixels, R (Red), G (Green) and B (Blue) in the order from the left thereof, that is, the horizontal direction of display is configured by 720 pixels.

In the display panel 15, a luminance of producing luminescence by the self-luminous element is regulated by a current amount flown into the self-luminous element and a luminous period of the self-luminous. The larger the current amount flown into the self-luminous element is, the higher the luminance of self-luminous element becomes. The longer the luminous period of self-luminous element is, the higher the luminance of self-luminous element becomes.

Figure 2:
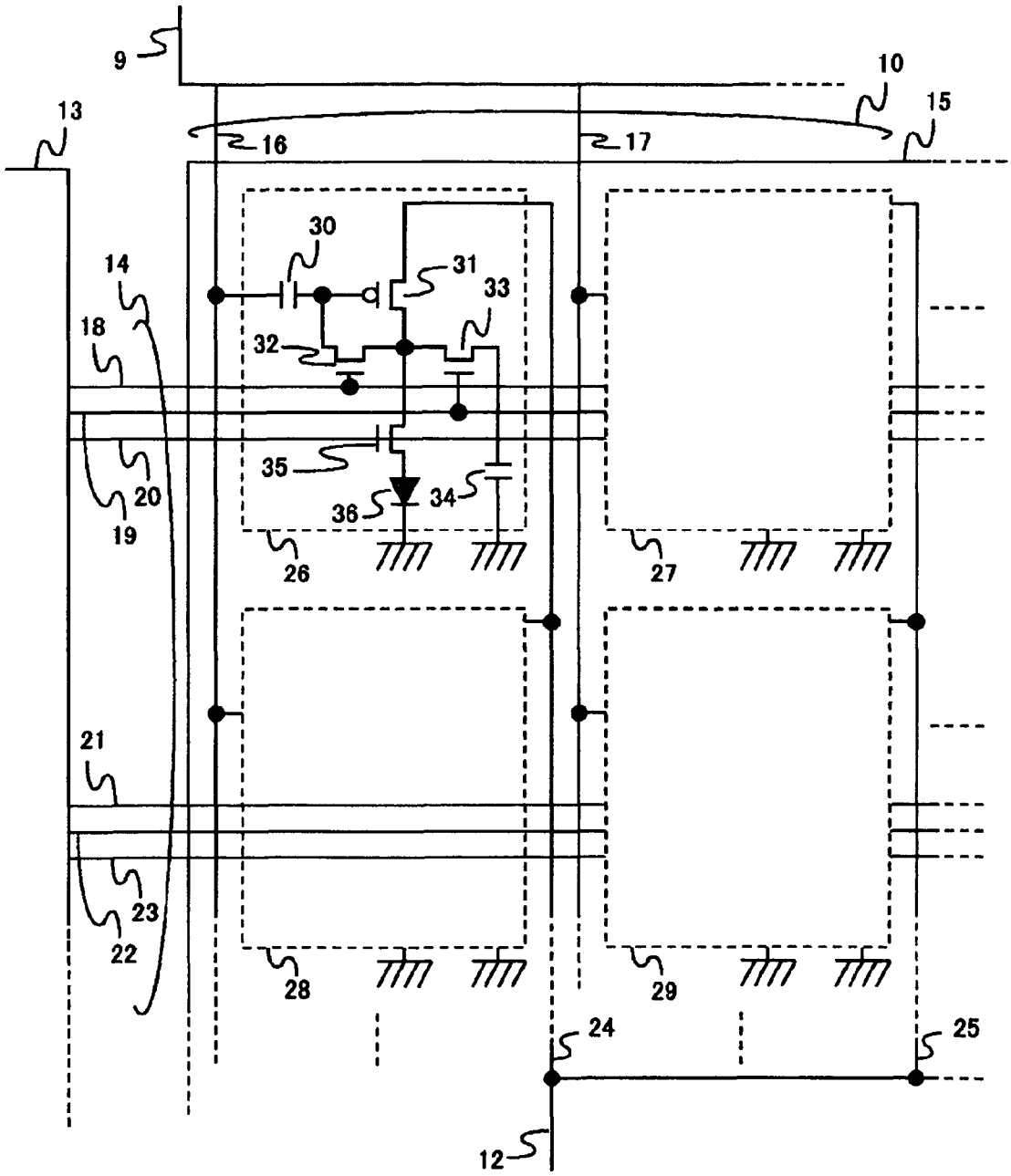
FIG. 2 is a diagram showing an inner configuration of the display panel in FIG. 1 by the embodiment.

FIG. 2 shows an inner configuration of the display panel 15 in an embodiment. This example uses an organic EL element as self-luminous element. Referring to FIG. 2, a reference numeral 16 denotes a first dot R data line; 17, a first dot G data line; 18, a first line reset selection line; 19, a first line characteristic hold selection line; 20, a first line luminous selection line; 21, a second line reset selection line; 22, a second line characteristic hold selection line; 23, a second line luminous selection line; 24, a first column organic EL element drive voltage supply line; 25, a second column organic EL element drive voltage supply line; 26, a first line first column pixel; 27, a first line second column pixel; 28, a second line first column pixel; and 29, a second line second column pixel.

The first dot R data line 16 and first dot G data line 17 are signal lines to input a first dot R signal, a first dot G signal and the sweep signal to the pixel.

The first line reset selection line 18, first line characteristic hold selection line 19, first line luminous selection line 20, second line reset selection line 21, second line characteristic hold selection line 22, and second line luminous selection line 23, write signal voltages into the pixels on the lines selected by the selection lines of the lines (rows), respectively, through the respective data lines. A luminous period of the pixel, which produces luminescence, is controlled by an organic EL element drive voltage supplied from the respective column organic EL element drive voltage supply lines in accordance with the signal voltages and sweep signal signals.

FIG. 2 shows the first line first column pixel 26 as the inner configuration of pixel alone, however, the same configuration is adopted for the first line second column pixel 27, second line first column pixel 28, second line second column pixel 29.

Further referring to FIG. 2, a reference numeral 30 denotes a writing capacitor; 31, a drive transistor; 32, a reset switch;

33, a characteristic hold switch; 34, a characteristic hold capacitor; 35, a luminance control switch; and 36, an organic EL element.

The reset switch 32 turns On-state by the first line reset selection line 18. The characteristic hold switch 33 turns On-state by the first line characteristic hold selection line 19. Therefore, a threshold characteristic is stored in the characteristic hold capacitor 34 with an input/output state of the drive transistor 31 short-circuited, and a signal voltage from the first dot R data line 16 is also accumulated into the writing capacitor 30 on the basis of the threshold characteristic.

The drive transistor 31 is switched its On and Off states by the level of sweep signal which varies in accordance with the writing signal voltage accumulated in the writing capacitor 30 and the luminance control switch 35 turned On-state by the first line luminous selection line 20 in response to the threshold value including the characteristic of organic EL element 36 and controls a time period for supplying a drive current to the organic EL element 36 from the first column organic EL element drive voltage supply line 24 in a luminous time period after a writing completion for all of the pixels. Therefore, the luminance of organic EL element 36 is determined by the writing signal voltage into the writing capacitor 30 and an organic EL element drive voltage.

Further, a next description will be concerned with the following condition. That is, the number of pixels of display panel 15 is 240×320 dots. The total number of line (row) selection lines is 960 because 3 lines for each of the lines in the horizontal direction are arranged from a first line to a 320th line in the vertical direction. The total number of data lines is 720 because the lines for Red, Green and Blue in the vertical direction are arranged from a first dot to a 240th dot. In addition, the organic EL element drive voltage supply line is connected to all of the pixels by lines parallel with the data lines from the under side of display panel 15. That is, the total number of lines in the vertical direction is 1440 aligned in the horizontal direction, which is also concerned with the following description below.

Figure 3:
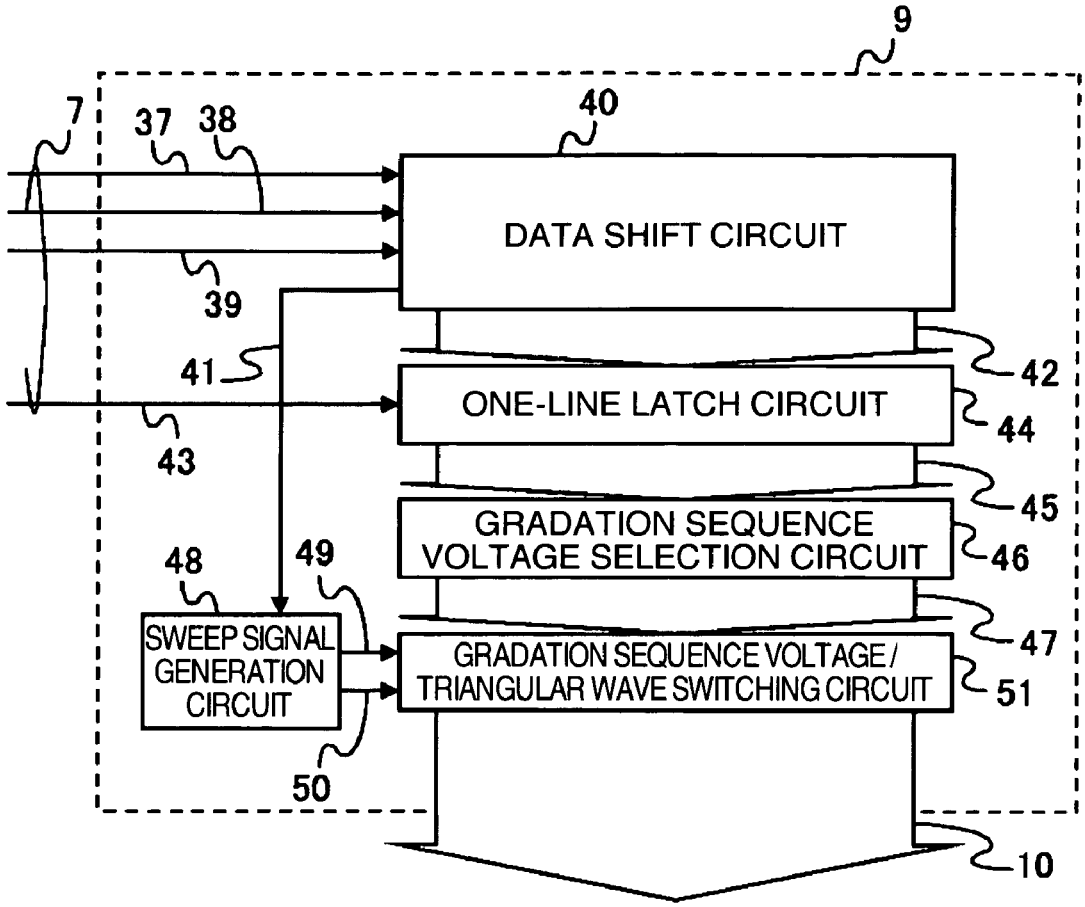
FIG. 3 is a diagram showing an inner configuration of the data line drive circuit 9 in FIG. 1 by the embodiment.

FIG. 3 shows an inner configuration of data line drive circuit 9 shown in FIG. 1 in an embodiment. Referring to FIG. 3, a reference numeral 37 denotes a data start pulse included in the data line control signal 7, 38 is a data clock also included in the data line control signal 7, 39 is display input data also included in the data line control signal 7, 40 is a data shift circuit, 41 is a fly-back period signal, and 42 is shift data.

The data shift circuit 40 fetches the display input data 39 by an amount of one line in one horizontal period in accordance with the data clock 38, as a reference of start to fetch the data start pulse 37, and outputs as the shift data 42. After fetching, the data shift circuit 40 generates the fly-back period signal 41 indicating a period up to a next fetching start.

Further referring to FIG. 3, a reference numeral 43 denotes a horizontal latch clock, 44 is a one-line latch circuit, and 45 is a one-line latch data. The one-line latch circuit 44 latches the shift data 42 by an amount of one line and synchronizes with the horizontal latch clock 43 to output as the one-line latch data 45.

Further, a reference numeral 46 denotes a gradation sequence voltage selection circuit, and 47 denotes a one-line display data. The gradation sequence voltage selection circuit 46 selects one level from 64-level gradation sequence voltages in accordance with the one-line latch data 45 to output as the one-line display data 47.

A method of generating the one-line display data 47 from the data line control signal 7 is the same as conventional one, except the generating operation of fly-back period signal 41.

Further, in FIG. 3, a reference numeral 48 denotes a sweep signal generation circuit, 49, a sweep signal signal, and 50, a sweep signal switching signal. The sweep signal generation circuit 48 generates and outputs the sweep signal 49 during the fly-back period in accordance with the fly-back period signal 41, and also generates the sweep signal switching signal 50 indicating a time period for outputting the sweep signal to the data line.

Further, a reference numeral 51 denotes a gradation voltage/sweep signal switching circuit. This circuit 51 switches the one-line display data 47 with the sweep signal 49 by the triangular switching signal 50 to output as the data line drive signal 10.

Figure 4:
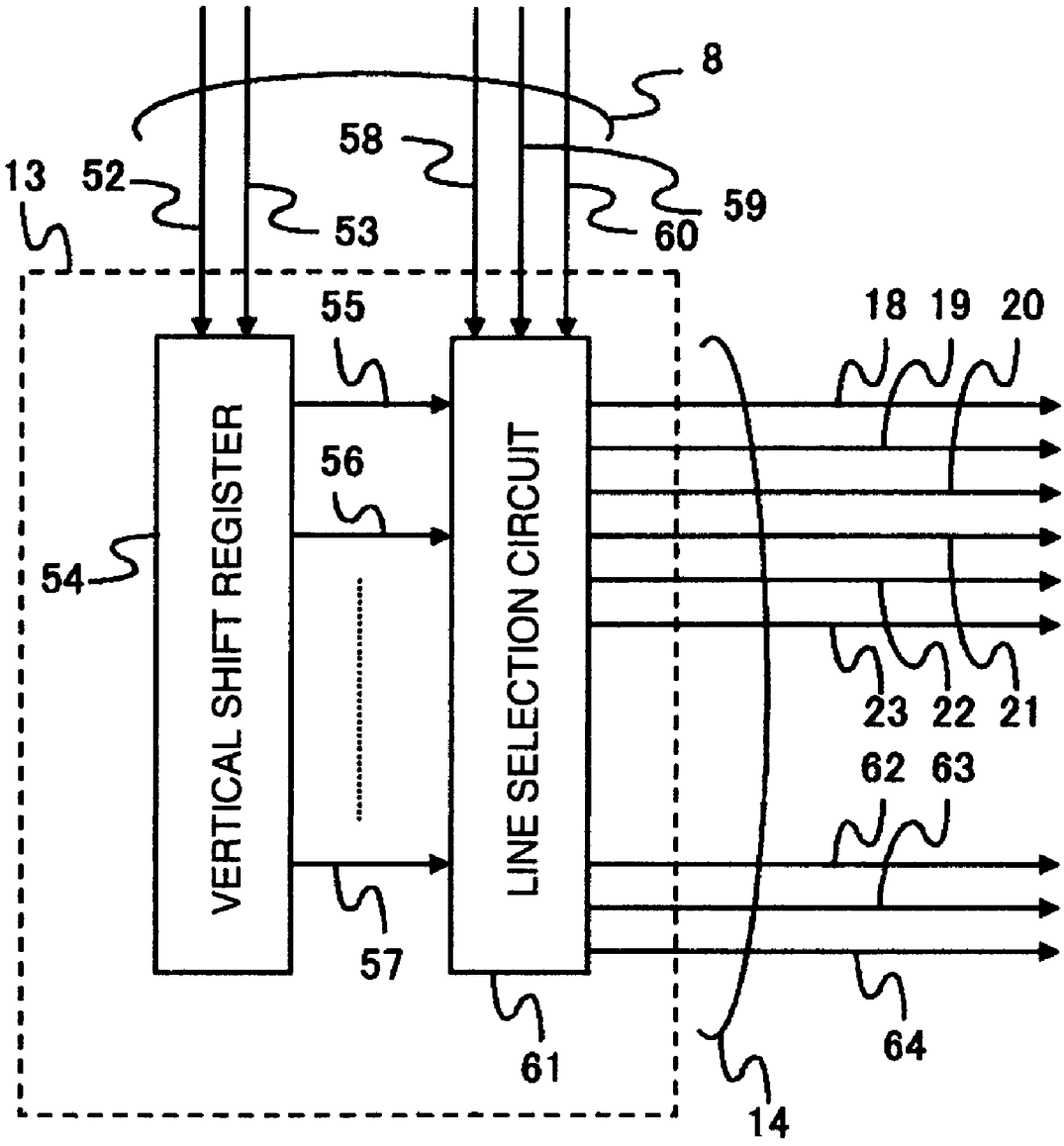
FIG. 4 is a diagram showing an inner configuration of the scanning line drive circuit 13 in FIG. 1 by the embodiment.

FIG. 4 shows an inner configuration of the scanning line drive circuit 13 shown in FIG. 1 in an embodiment. Referring to FIG. 4, a reference numeral 52 denotes a vertical start pulse included in the scanning line control signal 8, 53 is a vertical shift clock also included in the scanning line control signal 8, 54 is a vertical shift register, 55 is a first line selection signal, 56 is a second line selection signal, and 57 is a 320th line selection signal.

The vertical shift register 54 outputs, in turn, the first line selection signal 55, second line selection signal 56 up to the 320th line selection signal 57 by the vertical shift pulse 53 and vertical start pulse 52 indicating the head of vertical line.

Further referring to FIG. 4, a reference numeral 58 denotes a reset signal included in the scanning control signal 8 shown in FIG. 1; 59, a characteristic hold signal also included in the scanning line control signal 8; 60, a luminance control signal also included in the scanning line control signal 8; 61, a line selection circuit; 62, a 320th line reset selection line included in the scanning line drive signal 14 as shown in FIG. 1; 63, a 320th line characteristic hold selection line also included in the scanning line drive signal 14; and 64, a 320th line luminous selection line also included in the scanning line drive signal 14.

The line selection circuit 61 outputs the reset signal 58 and characteristic hold signal 59 for carrying out an On control at a time of writing a signal voltage to an only selected line among the first line selection signal 55, second line selection signal 56 up to the 320th line selection signal 57 to thereby output an On-state signal to the first line reset selection line 18 and first line characteristic hold selection line 19, or the second line reset selection line 21 and second line characteristic hold selection line 22, or the 320th line reset selection line 62 and 320th line characteristic hold selection line 63.

Further, on the luminous time period after writing the signal voltage into all of the pixels, a signal which turns all lines On-state simultaneously in the luminous time period, is output to the first line luminous selection line 20, the second line luminous selection line 23 and 320th line luminous selection line 64 from the luminance control signal 60 which carries out the On control.

The number of pixels of display panel 15 is 240×320 dots. Therefore, the total number of lines for the line selection signals or scanning drive signal 14 is 960 because 320 lines in the horizontal direction are aligned from the first line to the 320th line in the vertical direction, and 320 lines for each of the reset selection line, characteristic hold selection line and luminous selection line, in the horizontal direction are also aligned from the first line to the 320th line. A next description will be based on the above-mentioned condition below.

Figure 5:
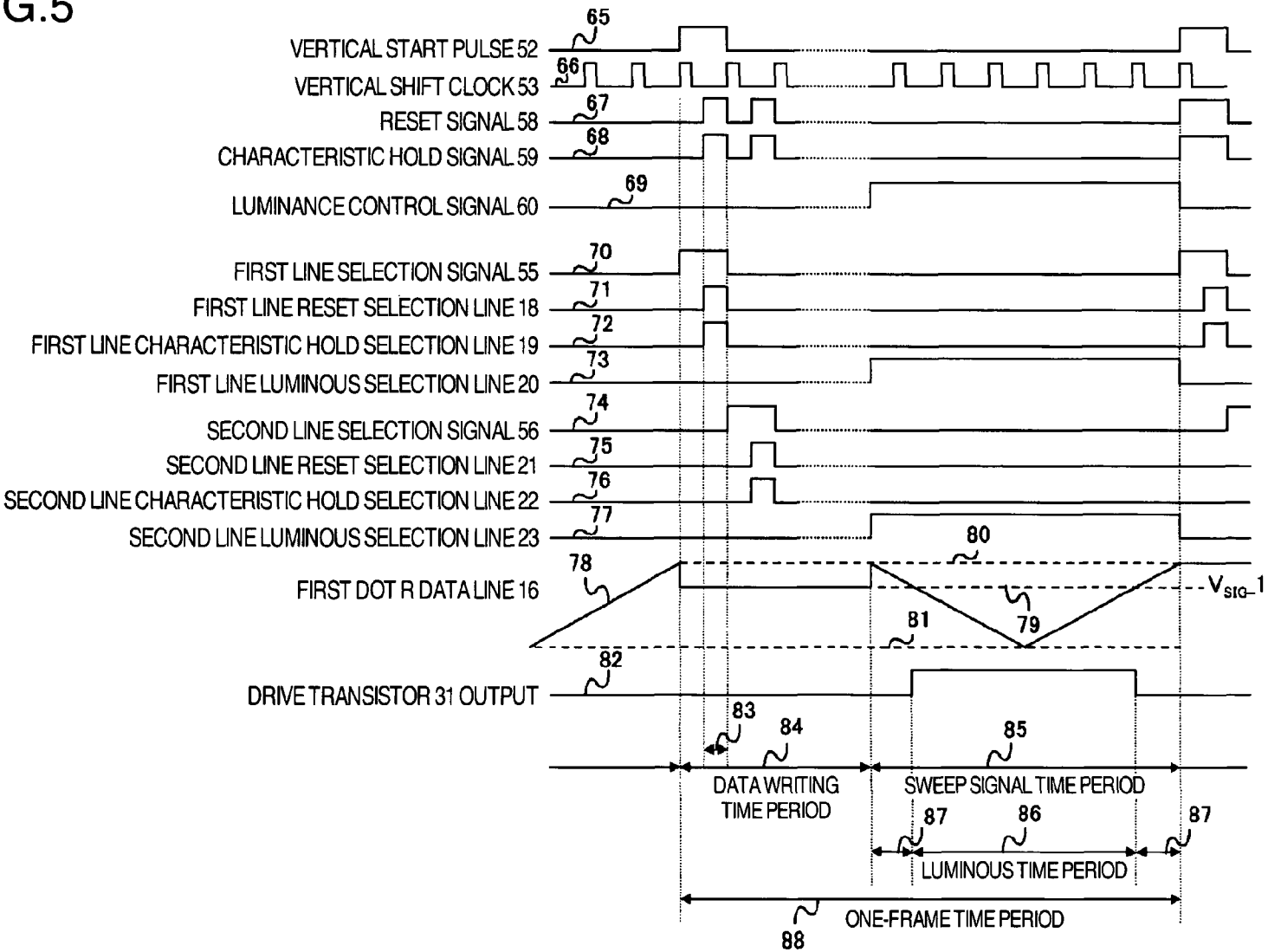
FIG. 5 is a timing diagram showing an operation of the vertical shift register 54 and line selection circuit 61 shown in FIG. 4 and an operation of the signal voltage writing in the first line first column pixel 26 in FIG. 2, and a control of the luminous period in the sweep signal signal.

FIG. 5 is a diagram showing an operation of the vertical shift register 54 and line selection circuit 61 shown in FIG. 4 and an operation of a control for writing the signal voltage in the first line first column pixel 26 and the luminous period by the sweep signal in FIG. 2. In addition, the sweep signal may be of a signal having a curve inclination portion instead of a linear inclination portion.

Referring to FIG. 5, a reference numeral 65 denotes a vertical start pulse waveform; 66, a vertical shift clock waveform; 67, a reset signal waveform; 68, a characteristic hold signal waveform; 69, a luminance control signal waveform; 70, a first line selection signal waveform; 71, a first line reset selection line waveform; 72, a first line characteristic hold selection line waveform; 73, a first line luminous selection line waveform; 74, a second line selection signal waveform; 75, a second line reset selection line waveform; 76, a second line characteristic hold selection line waveform; 77, a second line luminous selection line waveform; 78, a first dot R data line waveform; 79, a writing signal voltage level; 80, a sweep signal high voltage level; 81, a triangular low voltage level; 82, an output waveform of the first line first column pixel drive transistor 31; 83, a first line data writing time period; 84, a data writing time period; 85, a sweep signal time period; 86, a luminous time period; 87, a non-luminous time period; and 88, a one-frame time period.

The first line selection signal waveform 70 and second line selection signal waveform 74 turn sequentially "High" by shifting the vertical start pulse waveform 65 in accordance with the vertical shift clock waveform 66. The first line reset selection line waveform 71 is normally "Low" state, but turns "High" when the first line selection signal waveform 70 is "High" and the reset signal waveform 67 is "High". The first line characteristic hold selection line waveform 72 is normally "Low" state, but turns "High" when the first line selection signal waveform 70 is "High" and the characteristic hold signal waveform 68 is "High". The second line reset selection line waveform 75 is normally "Low" state, but turns "High" when the second line selection signal waveform 74 is "High and the reset signal waveform 67 is "High". The second line characteristic hold selection line waveform 76 is normally "Low" state, but turns "High" when the second line selection signal waveform 74 is "High" and the characteristic hold signal waveform 68 is "High".

That is, the vertical shift register 54 outputs a selection signal so that the first line to the 320th line turn sequentially "High". The line selection circuit 61 makes the reset signal and characteristic hold signal valid when the respective line selection signal waveforms are "High" alone, the following description will be concerned with a condition indicating that both the reset signal waveform 67 and the characteristic hold signal waveform 68 are the same in waveform.

The first line luminous selection line waveform 73 and second line luminous selection line waveform 77 are the luminance control signal waveform 69 which turns "High" during the sweep signal time period 85. This condition is common for all of the lines.

The first dot R data line waveform 78 becomes the writing signal voltage level 79 corresponding to display data in the data writing time period 84 within the one-frame time period 88. The first dot R data line waveform 78 then becomes the sweep signal high voltage level 80 after completion of writing data into all of the lines, and is changed to the triangular low voltage level 81 within the sweep signal time period 85 which is excluded with the data writing time period 84 from the one-frame time period 88, and again changed to the sweep signal high voltage level 80.

Here, it is assumed that the entire screen is displayed by the same gradation sequence, a writing signal voltage level of which is assumed as Vsig_1. The following description will be concerned with the above-mentioned condition. The potential Vsig_1 which is written into the pixel is held by the writing capacitor 30 to set to as a reference voltage for the gate input of drive transistor 31. The output waveform 82 of first line first column pixel drive transistor 31 turns "Low" within the sweep signal time period 85 while the sweep signal voltage level exceeds Vsig_1, and turns "High" while the sweep signal voltage level dips from Vsig_1.

Therefore, the power supply to the organic EL element 36 turns "Off state" or becomes the non-luminous time period 87 while the first line first column pixel drive transistor output waveform 82 is "Low". In contrast, the power supply to the organic EL element 36 turns "On state" or becomes the luminous time period 86, while the first line first column pixel drive transistor output waveform 82 is "High". According to the description above, a luminous time period in accordance with the signal voltage is determined. In addition, it is assumed that the foregoing signal voltage (data) input and sweep signal input are carried out within a predetermined cycle. In this embodiment, it is also assumed that these inputs are carried out in a time period within the one-frame time period 88 which becomes a 60 Hz frequency. The following description will be concerned with the above-mentioned condition below.

Figure 6:
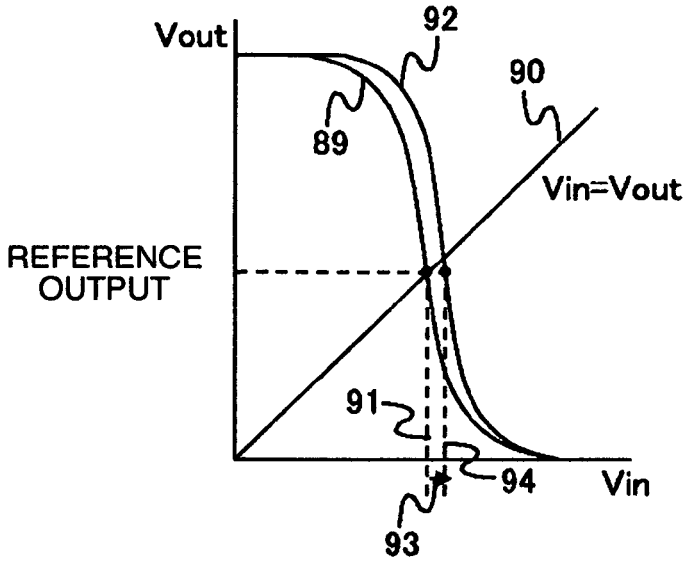
FIG. 6 is a detailed diagram showing the reference voltage setting of signal voltage in the drive transistor 31 in FIG. 2.

FIG. 6 is a diagram showing a detail of the reference voltage setting of the signal voltage in the drive transistor 31 shown in FIG. 2. Referring to FIG. 6, a reference numeral 89 denotes an input/output characteristic of the drive transistor 31. 90 is an input/output shorting condition. 91 is a signal voltage writing reference potential of the drive transistor 31. In the drive transistor 31, potentials at the input and output become the signal voltage writing reference potential 91 indicated by intersecting the input/output characteristic 89 with the input/output shorting condition 90 indicated by a straight line of Vin=Vout, because the input and output of the drive transistor 31 is short-circuited in the data writing. The writing of signal voltage is carried out on the basis of the signal voltage writing reference potential 91.

Referring back to FIG. 6, a reference numeral 92 denotes a luminous initial period input/output characteristic of the drive transistor 31 and organic EL element 36 at an initial luminous time. 93 is a threshold value shift amount. 94 is an organic EL element luminous threshold value. The luminous initial period input/output characteristic 92 given by a series of the drive transistor 31 and organic EL element 36 becomes the organic EL element luminous threshold value 94 by shifting the voltage of threshold value by the threshold value shift amount 93 so that an output voltage becomes the reference output, because the output voltage in response to the input rises by connecting the drive transistor 31 with the organic EL element 36 in luminescence.

Figure 7:
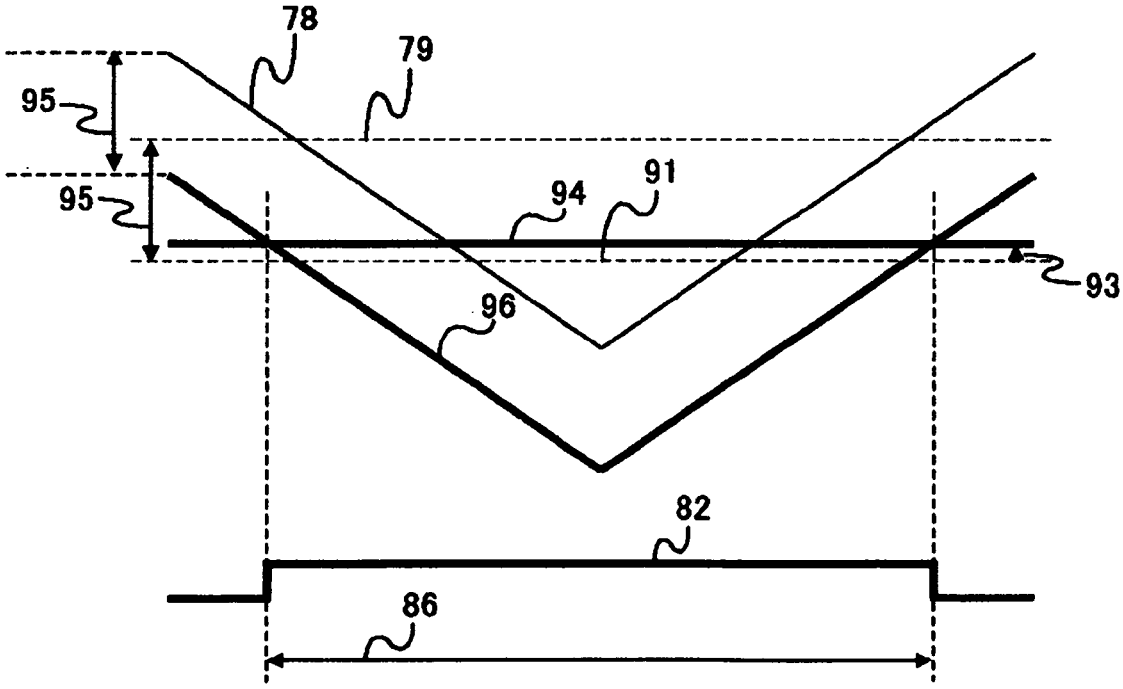
FIG. 7 is a detailed diagram showing the luminous time period control operation of drive transistor 31 in FIG. 2.

FIG. 7 is a diagram showing a detail of the luminous time period control operation in the drive transistor 31 shown in FIG. 2. Referring to FIG. 7, a reference numeral 95 denotes a writing capacitor voltage, and 96 is a drive transistor input voltage. The writing capacitor voltage 95 is a voltage to be accumulated when the signal voltage is written into the writing capacitor on the basis of the signal voltage writing reference potential 91. In this embodiment, the writing capacitor voltage is given by the following Expression (1) because the writing signal voltage is set to Vsig_1.

$$\text{writing capacitor voltage 95} = V\text{sig_1} - \text{signal voltage writing reference potential 91} \quad (1)$$

In FIG. 7, the drive transistor input voltage 96 becomes a voltage which holds a voltage difference from the first dot Red data line waveform 78 in the writing capacitor voltage 95. Further, the signal voltage writing reference potential 91 also becomes a level so that a voltage difference from the writing signal voltage level 79 becomes the writing capacitor voltage 95. The organic EL element luminous threshold value 94 becomes a level which rises from the signal voltage writing reference potential 91 by the threshold value shift amount 93.

As a result, the drive transistor output waveform 82 turns "Low" when the drive transistor input voltage 96 is larger than the organic EL element luminous threshold value 94, and turns "High" when the input voltage 96 is smaller than the threshold value 94. This time period of "High" becomes the luminous time period 86.

Figure 8:
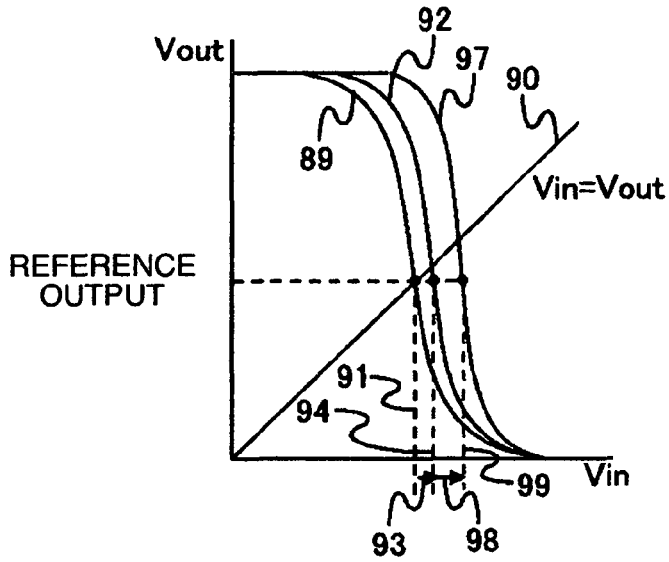
FIG. 8 is a detailed diagram showing a case indicating that the organic EL element 36 is deteriorated by causing time lapse in the reference voltage setting of signal voltage shown in FIG. 6.

FIG. 8 is a diagram showing a detail describing that the organic EL element 36 is deteriorated by causing temperature variation and time lapse in the reference voltage setting of signal voltage shown in FIG. 6. Referring to FIG. 8, a reference numeral 97 denotes a deteriorated input/output characteristic when the organic EL element 36 connected in series with the drive transistor 31 is deteriorated, 98 is a threshold value deterioration shift amount, and 99 is a deteriorated organic EL element luminous threshold value. The deteriorated input/output characteristic 97 becomes the deteriorated organic EL element luminous threshold value 99 by shifting the voltage of threshold value by the threshold value deterioration shift amount 98, because the output voltage rises compared with that in the luminous initial period by deterioration of organic EL element 36 connected with the drive transistor 31.

Figure 9:
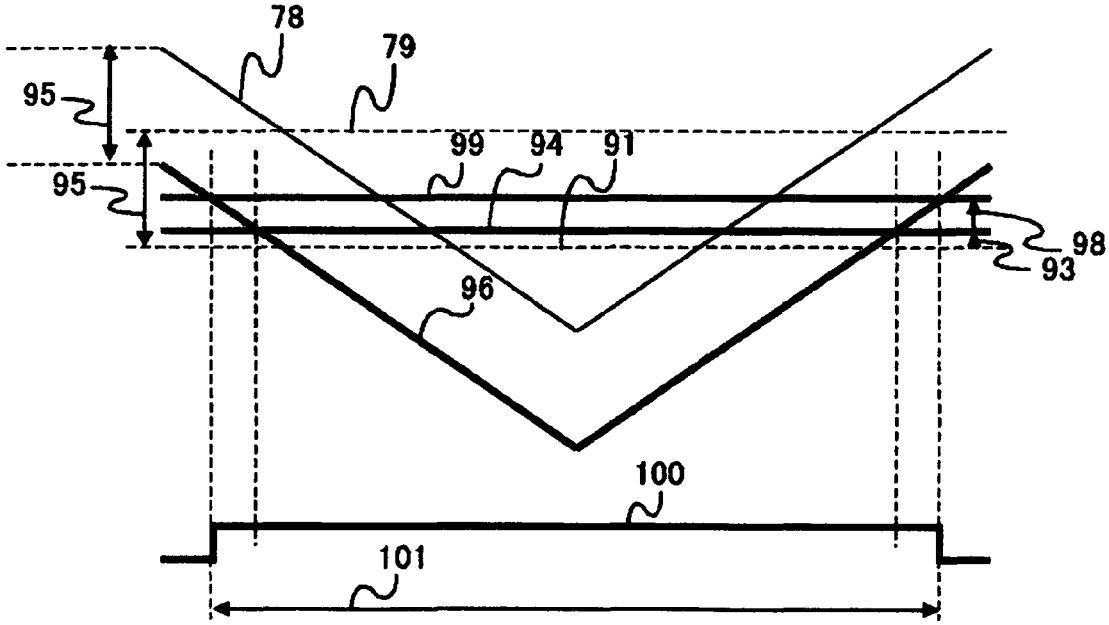
FIG. 9 is a detailed diagram showing a case indicating that the organic EL element 36 is deteriorated by causing time lapse in the luminous time period control operation in FIG. 7.

FIG. 9 is a diagram showing a detail describing that the organic EL element 36 is deteriorated by causing temperature variation and time lapse in the luminous time period control operation as shown in FIG. 7. Referring to FIG. 9, a reference numeral 100 denotes a deteriorated drive transistor output waveform, and 101 denotes a deteriorated luminous period. The deteriorated organic EL element luminous threshold value 99 is further shifted by the threshold value deterioration shift amount 98 from a level where the threshold value shift amount 93 rises from the signal voltage writing reference potential 91 alone. As a result, the deteriorated drive transistor output waveform 100 turns "Low" when the drive transistor input voltage 96 is larger than the deteriorated organic EL element luminous threshold value 99, and turns "High" when the drive transistor input voltage 96 is smaller than the deteriorated organic EL element luminous threshold value 99. A time period of "High" becomes the deteriorated time luminous period 101. The deteriorated luminous time period 101 becomes long by an amount of characteristic variation caused by the deterioration due to the time lapse of using the organic EL element 36 in comparison with the luminous time period 86 shown in FIG. 7.

Figure 10:
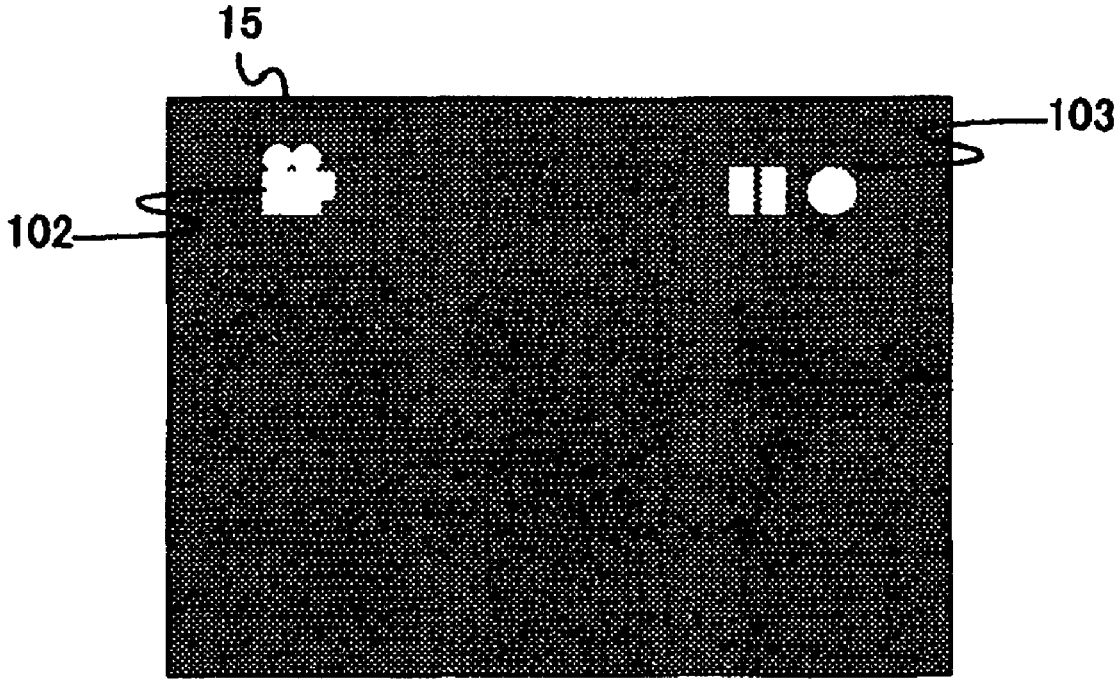
FIG. 10 is a diagram showing a display example indicating that a burn-in condition of the fixed pattern on the display panel 15 in FIG. 1.

FIG. 10 shows a display example which easily causes a burn-in state of fixed patterns displayed on the display panel 15 in FIG. 1. Referring to FIG. 10, a reference numeral 102 denotes an operation mode icon, and 103 is an operating condition icon. The operation mode icon 102 represents a condition by which a moving image displays on a DSC, mobile telephone, etc. The operating condition icon 103 is an icon representing an operating condition such as an actual moving image shooting, and a temporary suspension. In any event, these icons are displayed on predetermined positions in long, for example, on a pixel area occupied the left, right, top and bottom of the display panel 15. Eventually, the icons easily cause the burn-in state of fixed patterns.

Hereinafter, a control at a time of detecting a current in this embodiment will be described with reference to FIG. 1 to FIG. 10. First, a flow of the display data will be described with use of FIG. 1.

Referring to FIG. 1, the display control circuit 6 generates the data line control signal 7 and scanning line control signal 8 from the vertical sync signal 1, horizontal sync signal 2, data enable signal 3, display data 4 and sync clock 5, coordinated with a display timing of the display panel 15.

The data line drive circuit 9 outputs the data line drive signal 10 to the data line of display panel 15 by the data line control signal 7 including gradation sequence information during a signal voltage writing time period, and outputs a sweep signal signal as the data line drive signal 10 to the data line during the luminous time period.

The scanning drive circuit 13 outputs the scanning line drive signal 14 to control the scanning selection lines of display panel 15.

The drive voltage generation circuit 11 generates a drive voltage to produce luminescence from the organic EL element and supply as the panel supply drive voltage 12 to the display panel 15. Finally, the pixels on the scanning line selected by the scanning line drive signal 14 in the display panel 15 produce luminescence by the panel supply drive voltage 12 so that the luminous period is controlled in response to the signal voltage to compensate the deterioration of the self-luminous element having a burn-in state, by the signal voltage and sweep signal in the data line drive signal 10.

The luminance control of display panel 15 operated by the data line drive circuit 9 and scanning line drive circuit 13 and a burn-in state compensation drive in detail will be described with use of FIG. 2 to FIG. 9. First, a detail of the signal voltage writing and sweep signal input by the data line drive circuit 9 will be described with use of FIGS. 2, 3 and 5.

Referring to FIG. 3, the data shift circuit 40 latches the display input data 39 by the data start pulse 37 and data clock 38 to output the shift data 42. The one-line latch circuit 44 latches the shift data 42 fetched in the data shift circuit 40 by the horizontal latch clock 43 to output one-line latch data 45. The gradation sequence voltage selection circuit 46 selects one level from the 64 levels of gradation sequence voltage 64 by the one-line latch data 45 of 6-bit to output one-line display data 47.

The sweep signal generation circuit 48 generates the sweep signal 49 and sweep signal switching signal 50 in accordance with the fly-back period signal 41. As shown in FIG. 5, the sweep signal 49 drops from a maximum level to a minimum level within the sweep signal time period 85, thereafter, reaches up to the maximum level again.

Further, in FIG. 3, the gradation sequence voltage/sweep signal switching circuit 51 switches the one-line display data 47 and the sweep signal 49 to output the data lien drive signal 10. Further, the gradation sequence voltage/sweep signal switching circuit 51 selects the one-line display data 47 within the data writing time period 84 as shown in FIG. 5, and selects the sweep signal 49 within the sweep signal time period 85 to output the data line drive signal 15.

The data line drive signal 10 shown in FIG. 2 is supplied to the writing capacitor 30 of respective pixels through a 240th dot B data line (not shown) from the first dot R data line 16 and first dot G data line 17.

As described above, the data line drive circuit 9 writes the signal voltage into the display panel 15 within the data writing time period, and outputs the sweep signal within the luminous time period.

Next, the signal voltage writing and luminous period control by the scanning line drive circuit 13, and the burn-in state compensation operation will be described with use of FIGS. 2, 4 and 5 to 9 in detail.

First, in FIG. 4, the vertical shift register 54 shifts the vertical start pulse 52 in response to the vertical shift clock 53 to output sequentially, in turn, the first line selection signal 55, second line selection signal 56 and 320th line selection signal 57.

Further, the line selection circuit 61 outputs the reset signal 58 and characteristic hold signal 59 taking an AND operation with the first line selection signal 55, second line selection signal 56 and 320th line selection signal 57 which are outputted sequentially from the vertical shift register 54 line by line, to the first line reset selection line 18, first line characteristic hold selection line 19, second line reset selection line 21, second line characteristic hold selection line 22, 320th line reset selection line 62, and 320th line characteristic hold selection line 63 line by line, respectively.

The line selection circuit 61 also outputs the luminance control signal 60 indicating a luminous time period to the first line luminous selection line 20, second line luminous selection line 23 and 320th luminous selection line 64 so that the pixels in common with all of the lines turn "On". Here, the luminance control signal 60 has been described as generated by the display control circuit 6 shown in FIG. 1. However, the meaning of the signal 60 is the same as the fly-back period signal 41 shown in FIG. 3, therefore, it is possible to use the signal 41 instead of the signal 60.

Next, referring to FIG. 2, the reset switch 32 turns "On" state by the first line reset selection line 18, and the characteristic hold switch 33 turns "On" state by the first line characteristic hold selection line 19, within the data writing time period 84 shown in FIG. 5. Therefore, the input and output of drive transistor 31 become short-circuited state. For this reason, the reference potential 91 is determined as shown in FIG. 6, and accumulated in the characteristic hold capacitor 34. At the same time, a signal voltage input from the first dot R data line 16 based on the reference potential 91 is accumulated in the writing capacitor 30.

An operation of the following description in the luminous time period is divided into one case of an initial condition where the organic EL element 36 does not have deterioration caused by the time lapse and the other case of an element characteristic variation caused by the same. First, the case of the initial condition will be described with use of FIGS. 2, 6 and 7.

Referring to FIG. 2, the reset switch 32 and characteristic hold switch 33 are turned "Off" by the first line reset selection line 18 and first line characteristic hold selection line 19, and the luminance control switch 35 is turned "On" by the first line luminous selection line 20. In this way, the output voltage of drive transistor 31 rises by the resistance component of organic EL element 36, and the input/output characteristic of the drive transistor 31 and organic EL element 36 both connected in series becomes the luminous initial period input/output characteristic 92 as shown in FIG. 6. Thereby, the threshold value voltage indicating that the output voltage reaches to a reference output is shifted by the threshold value shift amount 93, which becomes the organic EL element luminous threshold value 94.

In this condition described above, the input voltage 96 of drive transistor 31 shown in FIG. 7 varies with the same condition of potential difference of the writing capacitor voltage 95, when a sweep signal is input from the first dot R data line 16. Here, the threshold value voltage of drive transistor 31 becomes the organic EL element luminous threshold value 94 as aforementioned above. For this reason, the drive transistor output waveform 82 shown in FIG. 7 turns "Low" when the drive transistor input voltage 96 is larger than the organic EL element luminous threshold value 94, and turns "High" when the input voltage 96 is smaller than the threshold value 94. This time period of "High" becomes the luminous time period 86 in the initial condition where there is no deterioration in the element.

Next, a condition where the characteristic of organic EL element 36 varies by causing the deterioration due to time lapse, that is, a burn-in phenomenon occurs, will be described with use of FIGS. 2, 8 and 9.

Similarly to the case of initial condition, in FIG. 2, the reset switch 32 and characteristic hold switch 33 are turned "Off" by the first line reset selection line 18 and first line characteristic hold selection line 19, and the luminance control switch 35 is turned "On" by the first line luminous selection line 20. In this way, the output voltage of drive transistor 31 rises by the resistance component of organic EL element 36, however, the resistance component at this time makes the current hardly flown due to the deterioration, that is, the resistance value rises. Consequently, the input/output characteristic of the drive transistor 31 and organic EL element 36 both connected in series becomes such as the deteriorated input/output characteristic 97. The threshold value voltage indicating that the output voltage reaches to the reference output is further shifted by the threshold value deterioration shift amount 98 to become the deteriorated organic EL element luminous threshold value 99.

In this condition described above, similarly to the case of initial condition, the input voltage 96 of drive transistor 31 shown in FIG. 9 varies with the same condition of potential difference of the writing capacitor voltage 95, when the sweep signal is input from the first dot R data line 16. Here, the threshold value voltage of drive transistor 31 becomes the deteriorated organic EL element luminous threshold value 99 as aforementioned above. For this reason, the deteriorated drive transistor output waveform 100 shown in FIG. 9 turns "Low" when the drive transistor input voltage 96 is larger than the deteriorated organic EL element luminous threshold value 99, and turns "High" when the input voltage 96 is smaller than the threshold value 99. This time period of "High" becomes the deteriorated time luminous period 101 in the condition where the element is deteriorated.

As described above, the luminous period becomes long when the organic EL element is deteriorated. Therefore, appropriate luminous period compensation and luminance compensation can be given to the pixel having a burn-in phenomenon of the fixed pattern shown in FIG. 10, thereby solving the burn-in state.

Further, the amount of luminance compensation can be regulated by controlling the inclination of sweep signal signal, therefore, the inclination can be varied in response to a luminance degradation amount by causing the deterioration of organic EL element. For example, even though the same display data is received and the same signal voltages are supplied to the organic EL elements, respectively, the inclination of sweep signal can be changed in response to the case where the deterioration progresses due to the time lapse and the temperature variation by using the element. Consequently, the luminance can be maintained to the extent necessary for human eyes without difficulty even though the same display data is received and the same signal voltages are supplied to the organic EL elements, because the luminance is restorable in response to the case where the deterioration progresses due to the time lapse and the temperature variation by using the element.

In addition, the drive transistor for inverting the input voltage is configured by a pMOS transistor, and the switch is configured by an nMOS transistor. However, their configurations are not limited by such transistors, any configurations may be acceptable if devices act as the inverter and switch.

Further, the pixel configuration including switches etc. are not limited by the embodiment, any configurations may be acceptable if it is possible to operate the pixel configuration such that the organic EL element is cut off in writing the signal voltage to hold the characteristic of drive transistor (inverter), and the organic EL element is connected in the luminous period alone.

Further, according to the embodiment, it is possible to carry out the luminance compensation for every pixel on an arbitrary display pattern. As a result, the invention exerts an advantage such that a fixed burn-in pattern is eliminated, also exerts an advantage for the luminance degradation caused by the deterioration of entire screen.

Embodiment 2

Figure 11:
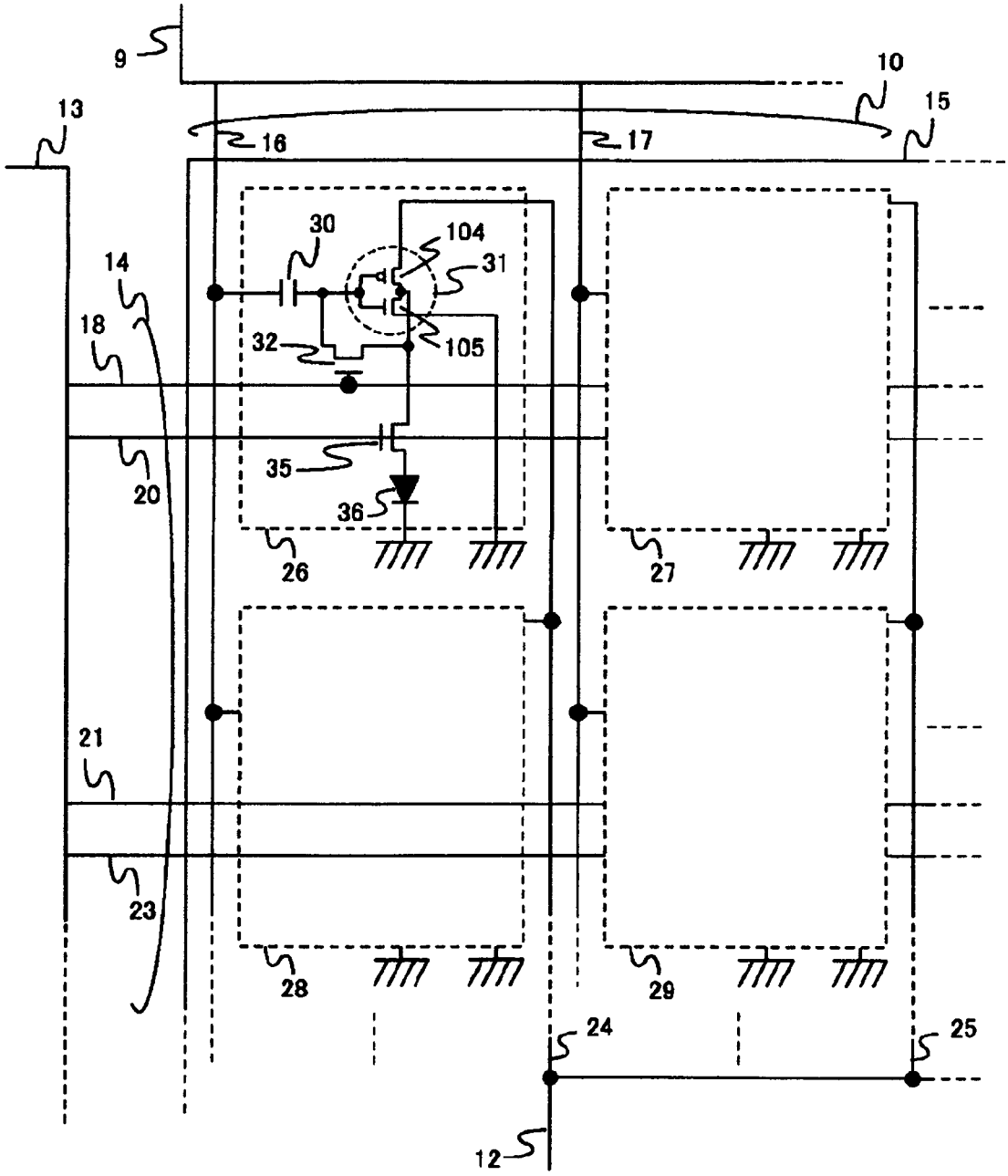
FIG. 11 is a diagram showing an inner configuration of the display panel 15 in FIG. 1 by another embodiment.

FIG. 11 is a diagram showing an inner configuration of the display panel 15 shown in FIG. 1 in another embodiment. A different configuration from that shown in FIG. 2 is that a pMOS transistor 104 and nMOS transistor 105 both connected in series are used as a drive transistor (inverter) 31 for inverting the input voltage. In this way, both the characteristic hold switch 33 for controlling the characteristic hold capacitor 34 and the first line characteristic hold selection line 19 for controlling the characteristic hold switch 33 can be eliminated from FIG. 2 in this embodiment, because the characteristic hold capacitor 34 in FIG. 2 can be omitted.

Referring to FIG. 11, the input of pMOS transistor 104 is connected with that of nMOS transistor 105, and the both inputs are further connected with a connection point of the writing capacitor 30 and reset switch 32. In addition, a connection point of the pMOS transistor 104 and nMOS transistor 105 both connected in series is connected with the luminance control switch 35. Further, an electrode positioned on the opposite side of the series connection point of pMOS transistor 104 is connected to the first column organic EL element drive voltage supply line 24. An electrode positioned on the opposite side of the series connection point of nMOS transistor 105 is then grounded.

In the case of this embodiment, a stray capacitance at the series connection point of the pMOS transistor 104 and nMOS transistor 105 is used in place of the characteristic hold capacitor 34 shown in FIG. 2. The writing operation of a signal voltage in the writing capacitor 30 is the same as that in the embodiment 1, as well as the luminous operation of organic EL element 36 is also the same.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device including a display panel having a plurality of pixels, each pixel having a data line configured to input a signal voltage into the pixel, wherein a pixel comprises:

a first capacitor, an end of which is connected to the data line;

an input voltage inverting transistor, an input of which is connected to another end of the first capacitor;

a luminous element which is controlled by an output of the input voltage inverting transistor;

a first switch provided between an input end of the transistor and an output end of the transistor;

a second switch provided between the output end of the transistor and the luminous element;

a second capacitor configured to store a characteristic of the luminous element, an end of which is connected to the ground; and a third switch provided between the output end of the transistor and another end of the second capacitor.

2. The device according to claim 1, wherein a first time period for inputting a signal voltage into the data line while the first switch turns On-state and the second switch turns Off-state is alternately and repeatedly changed with a second time period for inputting a sweep signal into the data line while the first switch turns Off-state and the second switch turns On-state.

3. The device according to claim 2, wherein the first time period plus the second time period is a one-frame time period.

4. The device according to claim 2, wherein an inclination of the sweep signal is varied in response to a duration of use or a temperature of the luminous element.

5. A display device, comprising:

a display panel arranged with a plurality of pixels a scanning line drive circuit for selecting a pixel arranged on the display panel; and a data line drive circuit for supplying a signal voltage to the pixel selected by the scanning line drive circuit;

wherein each pixel includes a luminous element, a transistor configured to drive the luminous element, a first capacitor configured to write the signal voltage in accordance with an input reference voltage of the transistor, and a second capacitor configured to store a characteristic of the luminous element; and wherein the transistor controls a luminous time period of the luminous element in accordance with the input reference voltage shifted in response to the characteristic of the luminous element which is stored in the second capacitor.

6. The device according to claim 5, wherein the pixel provides a reset switch configured to make a short-circuit between an input and an output of the transistor, and a luminance control switch disposed between the transistor and the luminous element.

7. The device according to claim 6, wherein the reset switch turns On during a first time period in one-frame time period, and the luminance control switch turns On during a second time period in the one-frame time period.

8. The device according to claim 7, wherein the data line drive circuit supplies a signal voltage to the pixel in the first time period, and supplies a triangular signal to the pixel in the second time period.

9. The device according to claim 8, wherein a linear inclination portion of the sweep signal is made into a curve inclination portion.

10. The device according to claim 5, wherein the characteristic of the luminous element is a characteristic indicating that a resistance value of the luminous element is varied by causing a deterioration due to variations of a temperature and a time lapse.

11. The device according to claim 1, and wherein the transistor controls a luminous time period of the luminous element in accordance with the input reference voltage shifted in response to the characteristic of the luminous element which is stored in the second capacitor.

12. A display device, comprising:

a display panel arranged with a plurality of pixels thereon, each pixel including a luminous element, a transistor to drive the luminous element, a first capacitor configured to write the signal voltage in accordance with an input reference voltage of the transistor, and a second capacitor configured to store a characteristic of the luminous element;

a scanning line drive circuit configured to select a pixel arranged on the display panel; and a data line drive circuit configured to supply a signal voltage to the pixel selected by the scanning line drive circuit;

wherein the transistor controls a luminous time period of the luminous element in accordance with the input reference voltage shifted in response to the characteristic of the luminous element which is stored in the second capacitor.

13. The device according to claim 12, further comprising in each pixel:

a reset switch configured to make a short-circuit between an input and an output of the transistor; and a luminance control switch disposed between the transistor and the luminous element.

14. The device according to claim 13, wherein the reset switch is configured to turn On during a first time period in one-frame time period, and wherein the luminance control switch is configured to turn On during a second time period in the one-frame time period.

15. The device according to claim 14, wherein the data line drive circuit is configured to supply a signal voltage to the pixel in the first time period, and to supply a triangular signal to the pixel in the second time period.

16. The device according to claim 15, wherein a linear inclination portion of the sweep signal is made into a curve inclination portion.

17. The device according to claim 12, wherein the characteristic of the luminous element is a characteristic configured to indicate that a resistance value of the luminous element needs to be varied due to a deterioration due to variations of a temperature and a time lapse.

* * * * *